US006659733B1

(12) United States Patent
Takenaka et al.

(10) Patent No.: US 6,659,733 B1
(45) Date of Patent: Dec. 9, 2003

(54) VARIABLE DISPLACEMENT COMPRESSOR

(75) Inventors: Kenji Takenaka, Kariya (JP); Tetsuhiko Fukanuma, Kariya (JP); Masahiro Kawaguchi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/937,411

(22) PCT Filed: Mar. 23, 2000

(86) PCT No.: PCT/JP00/01771

§ 371 (c)(1),
(2), (4) Date: Sep. 25, 2001

(87) PCT Pub. No.: WO00/58624

PCT Pub. Date: Oct. 5, 2000

(30) Foreign Application Priority Data

Mar. 26, 1999 (JP) ..... 11-083834

(51) Int. Cl.[7] ..... F04B 1/26
(52) U.S. Cl. ..... 417/222.1; 42/12.2
(58) Field of Search ..... 417/222.1, 222.2, 417/269; 62/222; 92/71, 12.2

(56) References Cited

U.S. PATENT DOCUMENTS 5,370,503 A * 12/1994 Terauchi ..... 417/222.2
5,380,166 A * 1/1995 Terauchi ..... 417/269
5,636,973 A * 6/1997 Sonobe et al. ..... 417/222.2
5,983,775 A * 11/1999 Fukai ..... 92/12.2
6,077,047 A * 6/2000 Nagai et al. ..... 417/222.1
6,146,107 A * 11/2000 Kawaguchi et al. ..... 417/222.2
6,158,968 A * 12/2000 Nakamura ..... 417/222.1
6,227,811 B1 * 5/2001 Ahn ..... 417/222.1
6,332,329 B1 * 12/2001 Takenaka et al. ..... 62/227
6,336,392 B1 * 1/2002 Fujita et al. ..... 92/71

FOREIGN PATENT DOCUMENTS

EP 0 628 722 A1 12/1994 ..... F04B/1/28
EP 0 844 392 A2 5/1998 ..... F04B/27/18
EP 0 848 164 A2 6/1998
JP 07-035040 2/1995 ..... F04B/27/08
JP 9-250452 9/1997 ..... F04B/27/08
JP 10-148177 6/1998 ..... F04B/27/14
JP 10-318283 12/1998 ..... F16D/7/02

* cited by examiner

*Primary Examiner*—Teresa Walberg
*Assistant Examiner*—Leonid Fastovsky
(74) *Attorney, Agent, or Firm*—Morgan & Finnegan, LLP

(57) ABSTRACT

A variable displacement compressor includes a cylinder block and a valve plate connected to the cylinder block. The cylinder block has cylinder bores and a central supporting hole. A piston is housed in each cylinder bore to compress gas. A swash plate is connected to the pistons to convert rotation of the drive shaft into reciprocation of the pistons. A cylindrical body is housed in the supporting hole. A coil spring located in the supporting hole presses the cylindrical body toward the swash plate. The cylindrical body moves axially as the swash plate is inclined. When the swash plate is minimally inclined, the valve plate receives force from the swash plate through the cylindrical body. Therefore, axial forces from the swash plate are not exerted on the drive shaft.

20 Claims, 5 Drawing Sheets

VARIABLE DISPLACEMENT COMPRESSOR

BACKGROUND OF THE INVENTION

The present invention relates to a variable displacement compressor capable of changing its displacement by changing the crank chamber pressure.

FIG. 5 shows a swash plate compressor to be used in a vehicle air conditioner. A crank chamber 82 is defined between a front housing 80 and a cylinder block 81. A drive shaft 83, which is driven by a vehicle engine, is supported by the crank chamber 82 and the cylinder block 81. The crank chamber 82 contains a lug plate 84 that rotates integrally with the drive shaft 83. A swash plate 85 is connected to the lug plate 84 through a hinge mechanism 102.

A plurality of cylinder bores 86 are defined in the cylinder block 81. Each cylinder bore 86 contains a piston 87. The drive shaft 83 rotates the swash plate 85 to make each piston 87 connected to the swash plate 85 reciprocate between a top dead center position and a bottom dead center position within the cylinder bores 86. The stroke of each piston 87 is changed depending on the inclination angle of the swash plate 85 to change the displacement of the compressor.

A valve plate 88 is located between the cylinder block 81 and a rear housing 89. The rear housing 89 contains a suction chamber 90 and a discharge chamber 91. As each piston 87 reciprocates, a refrigerant gas in the suction chamber 90 is caused to flow into the cylinder bore 86. After the refrigerant gas is compressed in the cylinder bore 86, it flows into the discharge chamber 91.

The inclination angle of the swash plate 85 is determined by controlling the internal pressure of the crank chamber 82 (crank chamber pressure) with an electromagnetic control valve 93. A supply passage 92 connects the discharge chamber 91 and the crank chamber 82 to each other through the electromagnetic control valve 93. The electromagnetic control valve 93 controls the quantity of refrigerant gas flowing into the crank chamber 82 through the supply passage 92. A bleed passage 94 connects the crank chamber 82 and the suction chamber 90 to each other. The refrigerant gas in the crank chamber 82 is allowed to flow into the suction chamber 90 through the bleed passage 94 constantly at a predetermined flow rate.

When no electric current is supplied to the control valve 93, the valve 93 opens fully. Thus, the refrigerant gas is introduced to the crank chamber 82 at the maximum flow rate through the supply passage 92. This increases the crank chamber pressure to cause the swash plate 85 to assume the minimum inclination angle. The control valve 93 closes when an electric current is supplied thereto, and the refrigerant gas cannot flow from the discharge chamber 91 into the crank chamber 82. This reduces the crank chamber pressure to cause the swash plate 85 to assume the maximum inclination angle.

The swash plate 85 assumes the maximum inclination angle and the minimum inclination angle when it abuts against the lug plate 84 and against a restriction ring 101 fixed to the drive shaft 83, respectively.

The clearance between the drive shaft 83 and the front housing 80 is sealed with a lip seal 95. The distal end of the drive shaft 83 protrudes outward through the housing. An electromagnetic clutch 96 is attached to that end of the drive shaft 83. The electromagnetic clutch 96 includes a fixed clutch disc **96*c* supported by the front housing 80, a movable clutch disc 96*a* fixed to the distal end of the drive shaft 83 to oppose the fixed clutch disc 96*c*, and an electromagnetic coil 96*b* for moving the movable clutch disc 96*a*. When an electric current is supplied to the electromagnetic coil 96*b*, the movable clutch disc 96*a* is brought into contact with the fixed clutch disc 96*c* to transmit the driving force of an engine E to the drive shaft 83**.

A thrust bearing 97 is located between the lug plate 84 and the front housing 80. The inner end of the drive shaft 83 is inserted to an insertion hole 98 defined in the cylinder block 81 and is supported therein. The insertion hole 98 contains a support spring 100, which is a compression spring. The support spring 100 is located between a snap ring 99 contained in the insertion hole 98 and a thrust bearing 103 attached to the inner end of the drive shaft 83. The support spring 100 urges the drive shaft 83 axially forward with respect to the front housing 80 (leftward in FIG. 5). The support spring 100 controls axial backlash of the drive shaft 83.

When a power switch of the air conditioner is turned off or when the engine E is stopped, the supply of electric current to the electromagnetic clutch 96 and to the control valve 93 is interrupted. Thus, the control valve 93 opens fully to let the refrigerant gas flow through the supply passage 92 into the crank chamber 82. Here, the crank chamber pressure increases temporarily to an excessively high degree due to the abrupt inflow of the gas. The swash plate 85 having moved to the minimum inclination angle position (indicated by the chain double-dashed line in FIG. 5) is then pressed against the restriction ring 101 with an excessive force. As a result, the drive shaft 83 retracts along its axis against the force of the support spring 100.

The displacement of the compressor is sometimes minimized to reduce the load of the compressor applied to the engine E during acceleration of a vehicle. In this case, the refrigerant gas flows rapidly into the crank chamber 82 as soon as the control valve 93 opens fully, which increases the crank chamber pressure temporarily to an excessively high degree. Thus, the drive shaft 83 retracts axially.

The retraction of the drive shaft 83 moves the pistons 87 toward the valve plate 88. Thus, each piston 87 impinges upon the valve plate 88 at the top dead center position and causes hammering or vibration.

The retraction of the drive shaft 83 also moves the movable clutch disc **96*a* of the electromagnetic clutch 96 backward. This brings the movable clutch disc 96*a* into contact with the fixed clutch disc 96*c*, although the electromagnetic coil 96*b* is demagnetized. As a result, the two clutch discs 96*a* and 96*c*** generate friction, abnormal noise and heat.

Further, if the drive shaft 83 retracts, the axial position of the drive shaft 83 changes with respect to the lip seal 95 held in the front housing 80. Normally, the drive shaft 83 is in contact with the lip seal 95 at a predetermined axial position. The drive shaft 83 has a foreign matter such as sludge deposited on its outer surface at a position spaced from the predetermined axial position. Therefore, if the axial position of the drive shaft 83 changes with respect to the lip seal 95, the sludge is caught between the lip seal 95 and the drive shaft 83. This lowers the sealing performance of the lip seal 95 and permits gas leakage from the crank chamber 82.

To solve the problems described above, it is possible to use a support spring 100 having a greater force so that the drive shaft 83 is not retracted by an excessively increased crank chamber pressure. In this case, however, excessive loads are applied to the thrust bearings 97 and 103, which causes power loss in the compressor.

SUMMARY OF THE INVENTION

It is an object of the present invention to provide a variable displacement compressor capable of preventing shifting of the drive shaft in the axial direction.

In order to attain the above object, the present invention provides a compressor capable of changing its displacement depending on the internal pressure of the crank chamber. The compressor has a housing. The housing contains a cylinder block and a valve plate to be connected to the cylinder block. The cylinder block contains cylinder bores and a supporting hole. A piston is housed in each cylinder bore to compress gas drawn into the cylinder bore through the valve plate. The compressed gas is discharged from the cylinder bore through the valve plate. A drive shaft supported in the housing has an end portion to be inserted into the supporting hole. A drive plate is connected operationally to the pistons to convert the rotation of the drive shaft into reciprocating motions of the pistons. The drive plate is supported on the drive shaft and can incline. The drive plate inclines between a maximum inclination angle position and a minimum inclination angle position depending on the internal pressure of the crank chamber. The inclination angle of the drive plate determines the piston stroke and the compressor displacement. A movable body is housed in the supporting hole to be able to move in the axial direction. The end portion of the drive shaft is supported in the cylinder block through the movable body. An urging member urges the movable body toward the drive plate to bring the former into abutment against the latter. The movable body moves along the axis of the drive shaft as the drive plate is inclined. When the drive plate is located at the minimum inclination angle position, the valve plate receives force from the drive plate through the movable body.

DETAILED DESCRIPTION OF THE PREFERRED EMBODIMENTS

The present invention will be described by way of a first embodiment referring to FIGS. 1 to 3, in which the present invention is embodied in a swash plate variable displacement compressor employed in a vehicular air conditioner.

Figure 1:
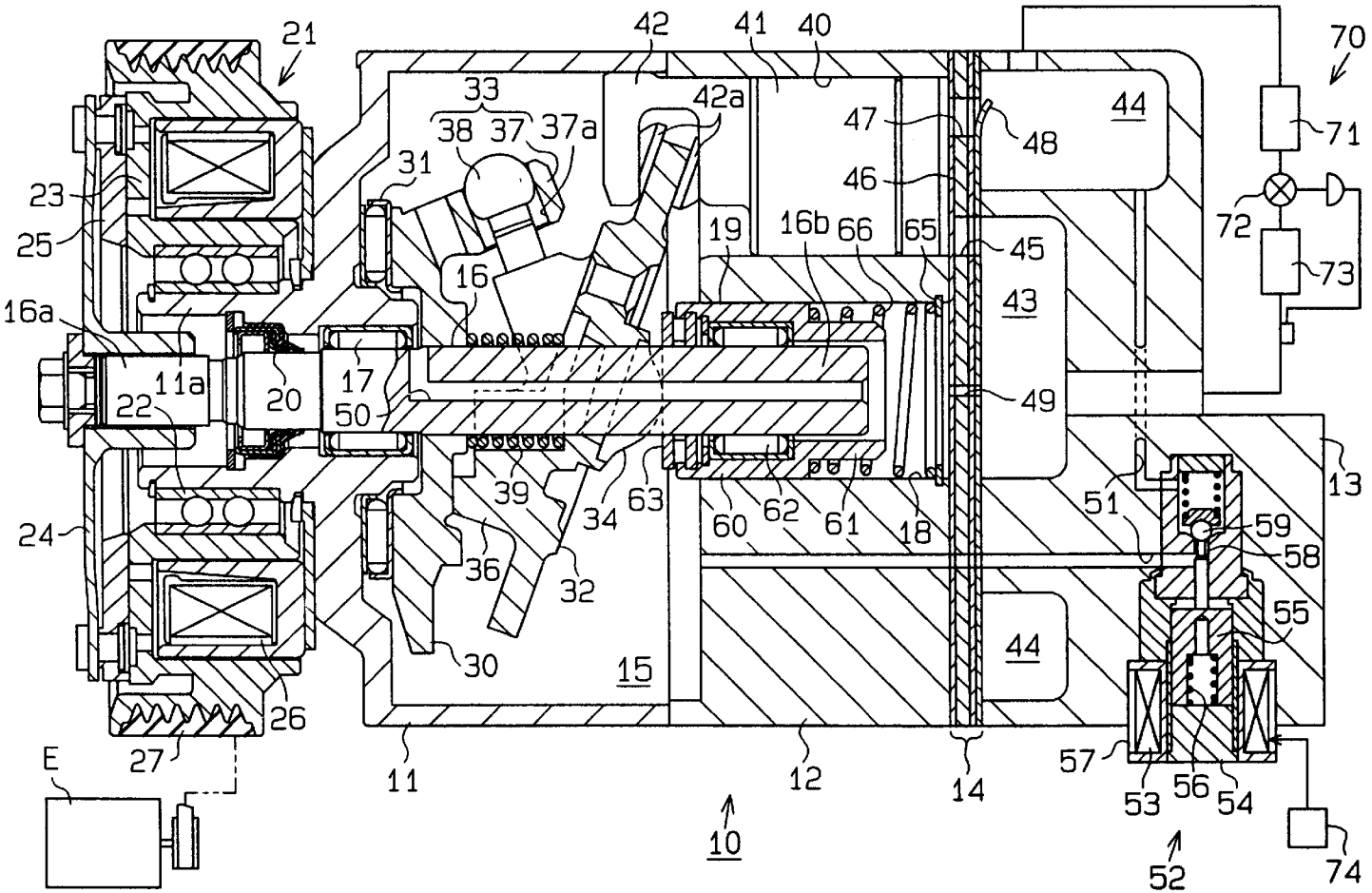
FIG. 1 is a cross-sectional view showing a variable displacement compressor according to a first embodiment of the present invention, with the swash plate assuming the maximum inclination angle.

As shown in FIG. 1, the compressor 10 has a housing composed of a front housing 11, a cylinder block 12, a rear housing 13 and a valve plate 14. The cylinder block 12 is fixed to the front housing 11. A crank chamber 15 is defined between the front housing 11 and the cylinder block 12. The rear housing 13 is fixed to the cylinder block 12 through the valve plate 14.

A drive shaft 16 is rotatably supported in the front housing 11 and the cylinder block 12. The drive shaft 16 is driven by a vehicular engine E as an external drive source. The drive shaft 16 is supported in the front housing 11 through a radial bearing 17. A first end 16*a* of the drive shaft 16 extends outward through the front housing 11. A supporting hole 18 is defined substantially at the center of the cylinder block 12. A second end 16*b* of the drive shaft 16 is located in the supporting hole 18. The second end 16*b* is supported in the cylinder block 12 through a cylindrical body 19, or a movable body, located in the supporting hole 18.

A supporting cylinder 11*a* is formed at the distal end of the front housing 11. A lip seal 20 is located between the drive shaft 16 and the supporting cylinder 11*a* to seal the crank chamber 15. The lip seal 20 contains a plurality of lip rings and a plurality of backup rings which are built up alternately. The drive shaft 16 is brought into contact with the lip seal 20 at a predetermined axial position.

An electromagnetic clutch 21 is located between the first end 16*a* of the drive shaft 16 and the engine E. The electromagnetic clutch 21 selectively transmits the driving force of the engine E to the drive shaft 16. The electromagnetic clutch 21 contains a rotor 23 serving as a fixed clutch disc, a hub 24, an armature 25 serving as a movable clutch disc, and an electromagnetic coil 26. The rotor 23 is rotatably supported at the front end of the front housing 11 through an angular bearing 22. A belt 27 is wrapped around the rotor 23 to transmit the power of the engine E to the rotor 23. The hub 24, which is resilient, is fixed to the front end of the drive shaft 16. The hub 24 supports the armature 25. The armature 25 is located to oppose the rotor 23. The electromagnetic coil 26 is supported on the front wall of the front housing 11 to oppose the armature 25 across the rotor 23.

When the electromagnetic coil 26 is magnetized, or when the electromagnetic clutch 21 is turned on, the armature 25 is pulled by the rotor 23 into contact with the rotor 23 against the resilience of the hub 24. Thus, the driving force of the engine E is transmitted to the drive shaft 16. When the electromagnetic coil 26 is demagnetized in this state, or when the electromagnetic clutch 21 is turned off, the armature 25 is spaced from the rotor 23 to interrupt transmission of power from the engine E to the drive shaft 16.

A lug plate 30 is fixed to the drive shaft 16 within the crank chamber 15. A thrust bearing 31 is located between the lug plate 30 and the internal wall surface of the front housing 11. A hinge mechanism 33 connects the lug plate 30 to a swash plate 32, or a drive plate.

The swash plate 32 is supported on the drive shaft 16 to incline with respect to the drive shaft 16 and to move along the drive shaft 16 axially. The swash plate 32 has a counterweight 36 protruding toward the lug plate 30. The swash plate 32 also has an abutting portion 34 protruding toward the cylinder block 12.

Figure 3:
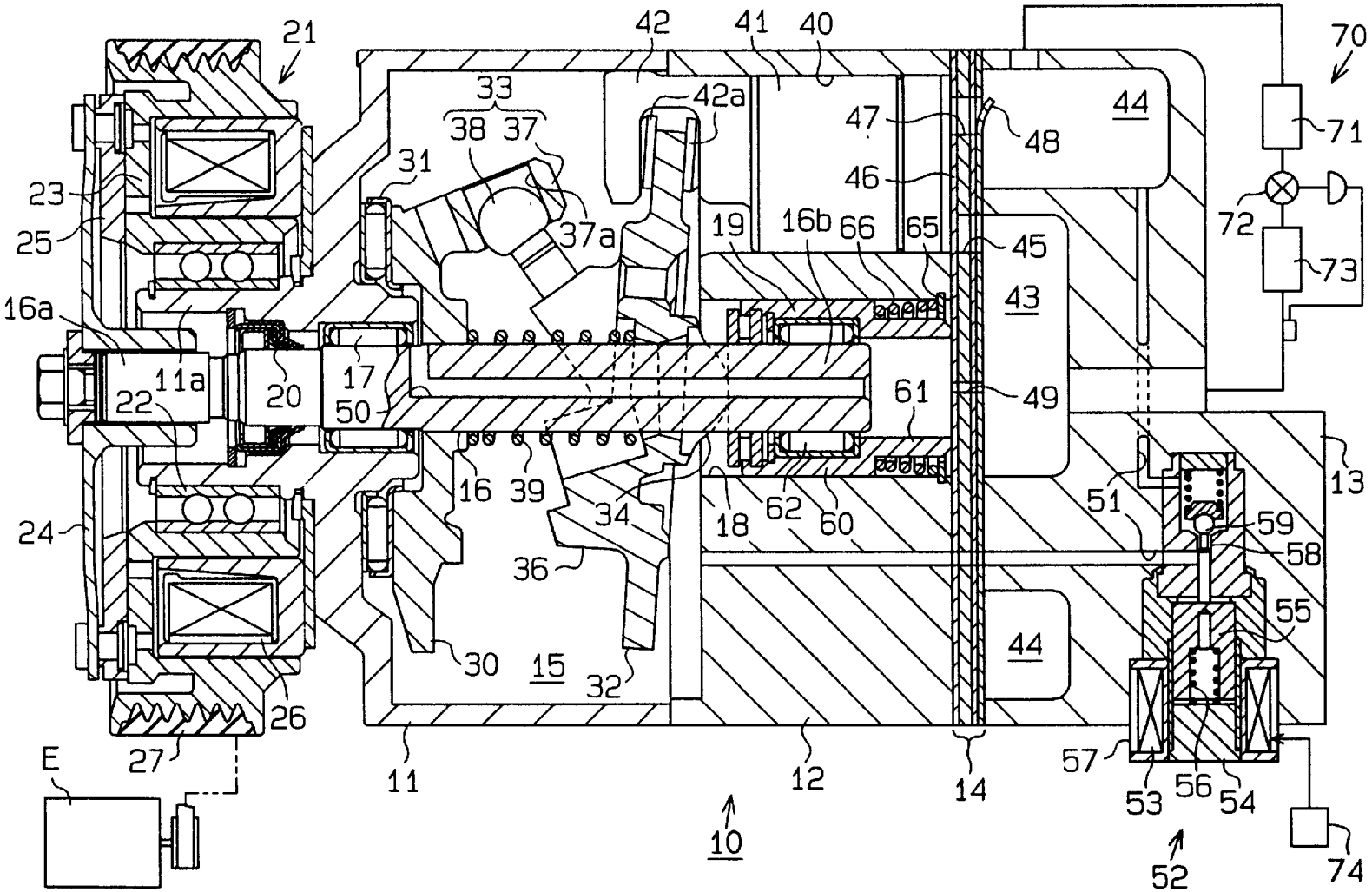
FIG. 3 is a cross-sectional view showing the compressor shown in FIG. 1, with the swash plate assuming the minimum inclination angle.

As shown in FIGS. 1 and 3, the hinge mechanism 33 is composed of a pair of guide pins 38 extending from the swash plate 32 and a pair of supporting arms 37 extending from the lug plate 30. A guide hole 37*a* is formed through each supporting arm 37 at the distal end portion thereof. The guide pins 38 are inserted into the opposing guide holes 37*a* respectively. The hinge mechanism 33 rotates the swash plate 32 integrally with the drive shaft 16. The hinge mechanism 33 also guides the movement of the swash plate 32 in the axial direction of the drive shaft 16 and the inclination of the swash plate 32.

A first coil spring 39, which is a compression spring, is fitted on the outer surface of the drive shaft 16 between the lug plate 30 and the swash plate 32. The first coil spring 39 urges the swash plate 32 backward (rightward in FIG. 1) to reduce the inclination angle of the swash plate 32.

A plurality of cylinder bores 40 are defined in the cylinder block 12 to extend in the axial direction of the drive shaft 16. The cylinder bores 40 are defined at predetermined intervals on a circle centered on the axis of the drive shaft 16. Each cylinder bore 40 contains a single-headed piston 41. Each piston 41 is connected to the swash plate 32 through a pair of shoes 42*a*. The rotational motion of the swash plate 32 is converted through the shoes 42*a* into reciprocating motion of the pistons 41 in the cylinder bores 40.

A suction chamber 43 and a discharge chamber 44 are defined in the rear housing 13 to form a suction pressure region and a discharge pressure region, respectively. The valve plate 14 has a suction port 45, a suction valve 46, a discharge port 47 and a discharge valve 48 for each cylinder bore 40. In the stroke in which a piston 41 travels from the top dead center position to the bottom dead center position, the refrigerant gas in the suction chamber 43 opens the suction valve 46 and flows through the suction port 45 into the opposing cylinder bore 40. In the stroke in which the piston 41 travels from the bottom dead center position to the top dead center position, the refrigerant gas in the cylinder bore 40 is compressed to a predetermined pressure and then opens the discharge valve 48 and is discharged through the discharge port 47 into the discharge chamber 44.

An axial passage 50 is defined in the drive shaft 16 to connect the crank chamber 15 to the supporting hole 18. A communicating port 49 is defined in the valve plate 14 to connect the supporting hole 18 to the suction chamber 43. In this embodiment, the axial passage 50, the supporting hole 18 and the communicating port 49 constitute a bleed passage for bleeding the gas from the crank chamber 15 into the suction chamber 43.

A supply passage 51 is defined through the cylinder block 12, the valve plate 14 and the rear housing 13 to connect the crank chamber 15 to the discharge chamber 44. An electromagnetic control valve 52 is located in the supply passage 51 to change the flow rate of refrigerant gas flowing from the discharge chamber 44 into the crank chamber 15. The electromagnetic control valve 52 is controlled based on external commands.

The electromagnetic control valve 52 is an electromagnetic proportional control valve and has a solenoid 57 containing a coil 53, a fixed iron core 54, a movable iron core 55 and a return spring 56. The return spring 56 urges the movable iron core 55 away from the fixed iron core 54. When an electric current is supplied to the coil 53, the movable iron core 55 shifts toward the fixed iron core 54 against the force of the return spring 56. A valve body 59 is connected to the movable iron core 55. A valve hole 58 is defined in the supply passage 51. The movable iron core 55 makes the valve body 59 change the opening degree of the valve hole 58 depending on the value of electric current supplied to the coil 53.

Figure 2:
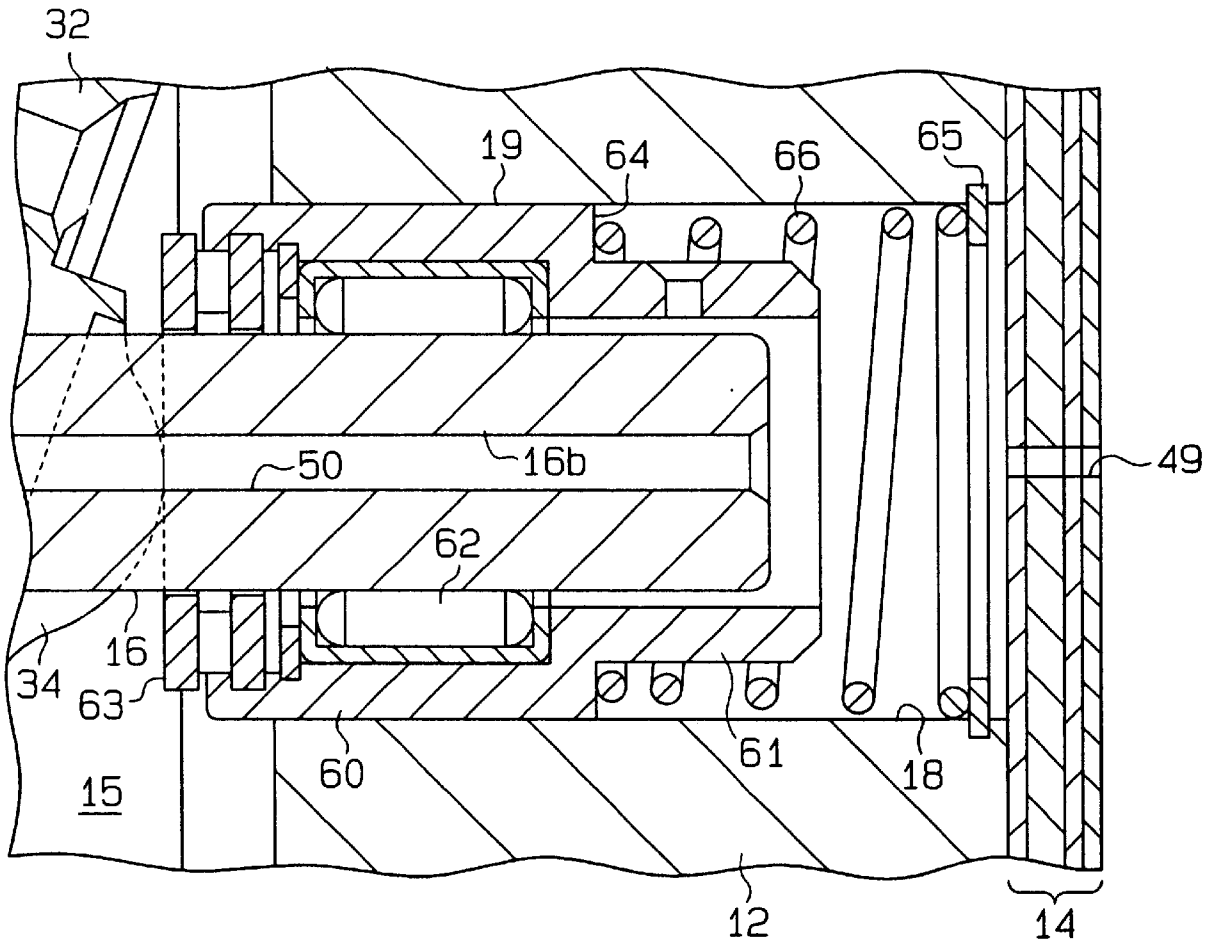
FIG. 2 is a partial enlarged cross-sectional view of the compressor shown in FIG. 1.

As shown in FIG. 2, a cylindrical supporting hole 18 is defined through the cylinder block 12 to extend along the axis of the drive shaft 16. The cylindrical body 19 is contained in the supporting hole 18 to be movable in the axial direction. The cylindrical body 19 is brought into sliding contact with the inner surface of the supporting hole 18. The cylindrical body 19 has a large-diameter portion 60 and a small-diameter portion 61.

A radial bearing 62 is fixed to the inner surface of the large-diameter portion 60. The second end 16*b* of the drive shaft 16 is supported in the cylindrical body 19 to rotate through the radial bearing 62 and to move axially . A thrust bearing 63 is located between the end face of the cylindrical body 19 and the abutting portion 34 of the swash plate 32. The thrust bearing 63 permits rotation of the swash plate 32 and the cylindrical body 19 relative to each other.

A step 64 is formed between the large-diameter portion 60 and the small-diameter portion 61. A second coil spring 66 is located as an urging member between the step 64 and a snap ring 65 fixed to the inner circumference of the supporting hole 18.

The second coil spring 66 urges the cylindrical body 19 toward the swash plate 32 such that the thrust bearing 63 abuts against the abutting portion 34 of the swash plate 32. The second coil spring 66 also urges the drive shaft 16 forward through the cylindrical body 19, the thrust bearing 63, the swash plate 32, the hinge mechanism 33, the first coil spring 39 and the lug plate 30. As a result, axial backlash of the drive shaft 16 is suppressed.

The inclination angle of the swash plate 32 is determined by various moments acting upon it, including a moment based on the centrifugal force acting upon the rotating swash plate 32; moments based on the inertia forces of the reciprocating pistons 41; moments based on the forces of the coil springs 39 and 66; and a moment based on the gas pressure acting upon each piston 41. The moment based on the gas pressure includes the moment based on the internal pressure of the crank chamber 15 (crank chamber pressure) and the moment based on the internal pressure of each cylinder bore 40 (bore pressure).

In this embodiment, the inclination angle of the swash plate 32 is controlled by changing the crank chamber pressure with the control valve 52. A reduction in the crank chamber pressure increases the inclination angle of the swash plate 32 and increases the stroke of each piston 41. As a result, the displacement of the compressor is increased. Meanwhile, an increase in the crank chamber pressure reduces the inclination angle of the swash plate 32 and reduces the stroke of each piston 41. As a result, the displacement of the compressor is reduced. If the compressor is stopped, and the crank chamber pressure is equalized with the bore pressure, the swash plate 32 is located at the minimum inclination angle position by the forces of the springs 39 and 66.

As shown in FIG. 1, when the counterweight 36 abuts against the lug plate 30, the swash plate 32 is located at the maximum inclination angle position. Meanwhile, as shown in FIG. 3, when the cylindrical body 19 abuts against the valve plate 14, the swash plate 32 is regulated to be at the minimum inclination angle position. Here, the cylindrical body 19 does not block the communicating port 49.

The suction chamber 43 and the discharge chamber 44 are connected to each other through an external refrigerant circuit 70, as shown in FIG. 1. The external refrigerant circuit 70 includes a condenser 71, an expansion valve 72 and an evaporator 73. A controller 74 controls the value of electric current to be supplied to the control valve 52 to change the opening degree thereof based on external information from various sensors or selecting switches (not shown).

The operation of the compressor having the constitution described above will be described below.

When a request for cooling is output to the controller 74 when the engine E is operating, the electromagnetic clutch 21 connects the drive shaft 16 to the engine E based on a command from the controller 74. Thus, the compressor is started to allow each piston 41 to reciprocate with a stroke that depends on the inclination angle of the swash plate 32. As a result, the refrigerant gas circulates through the external refrigerant circuit 70 and the compressor.

When the controller 74 reduces the opening degree of the control valve 52, the quantity of refrigerant gas flowing into the crank chamber 15 is reduced to lower the crank chamber pressure. This increases the inclination angle of the swash plate 32 and increases the stroke of each piston 41 and the displacement of the compressor 10.

When the controller 74 increases the opening degree of the control valve 52, the flow rate of refrigerant gas flowing into the crank chamber 15 increases, which increases the crank chamber pressure. This reduces the inclination angle of the swash plate 32, the stroke of each piston 41, and the displacement of the compressor 10.

The cylindrical body 19 is pressed against the swash plate 32 by the second coil spring 66. Thus, the cylindrical body 19 moves along the drive shaft 16 with the inclination of the swash plate 32.

If cooling is interrupted or the engine E is stopped in when the displacement of the compressor 19 is the maximum or the crank chamber pressure is low, the electromagnetic clutch 21 is turned off, which interrupts the supply of electric current to the electromagnetic control valve 52, and the valve 52 opens fully. Thus, the refrigerant gas flows at a large flow rate from the discharge chamber 44 into the crank chamber 15. The flow rate of refrigerant gas from the crank chamber 15 through the bleed passage (50, 18, 49) into the suction chamber 43 is not very large, so the crank chamber pressure increases rapidly, and the swash plate 32 rushes toward the minimum inclination angle position against the force of the second coil spring 66. As shown in FIG. 3, when the cylindrical body 19 abuts against the valve plate 14, the swash plate 32 is located at the minimum inclination angle position and retracts no further.

The force based on the crank chamber pressure that urges the swash plate 32 toward the minimum inclination angle position is received by the valve plate 14 through the cylindrical body 19 and exerts no influence on the drive shaft 16. Thus, the drive shaft 16 does not retract even if the crank chamber pressure is increased excessively. The second coil spring 66 moderates the impact of the cylindrical body 19 against the valve plate 14.

Since axial movement of the drive shaft 16 is prevented, the various problems as described in the paragraphs of the prior art section, axial dislocation of the drive shaft 16 relative to the lip seal 20, contact between the armature 25 and the rotor 23 when the clutch 21 is turned off, and impingement of pistons 41 against the valve plate 14 are solved.

The mechanism of preventing axial movement of the drive shaft 16 is housed in the supporting hole 18 of cylinder block 12. This helps to miniaturize the compressor 10.

The electromagnetic control valve 52 can change the crank chamber pressure rapidly compared with a control valve that changes the crank chamber pressure in accordance with the operation of a pressure-sensing element, such as bellows, that depends on the suction pressure. Therefore, the compressor in this embodiment, which has the electromagnetic control valve 52, can change the displacement rapidly while preventing movement of the drive shaft 16.

The control valve 52 fully opens the supply passage 51 to increase the crank chamber pressure, when no electric current is supplied thereto. This causes the compressor to have the minimum displacement when it is stopped. Thus, the compressor 10 is started with the minimum load or the minimum displacement whenever cooling is restarted or the engine E is restarted.

The supporting hole 18 is cylindrical. Therefore, the supporting hole 18 can be machined easily.

The present invention may be modified as follows.

Figure 4:
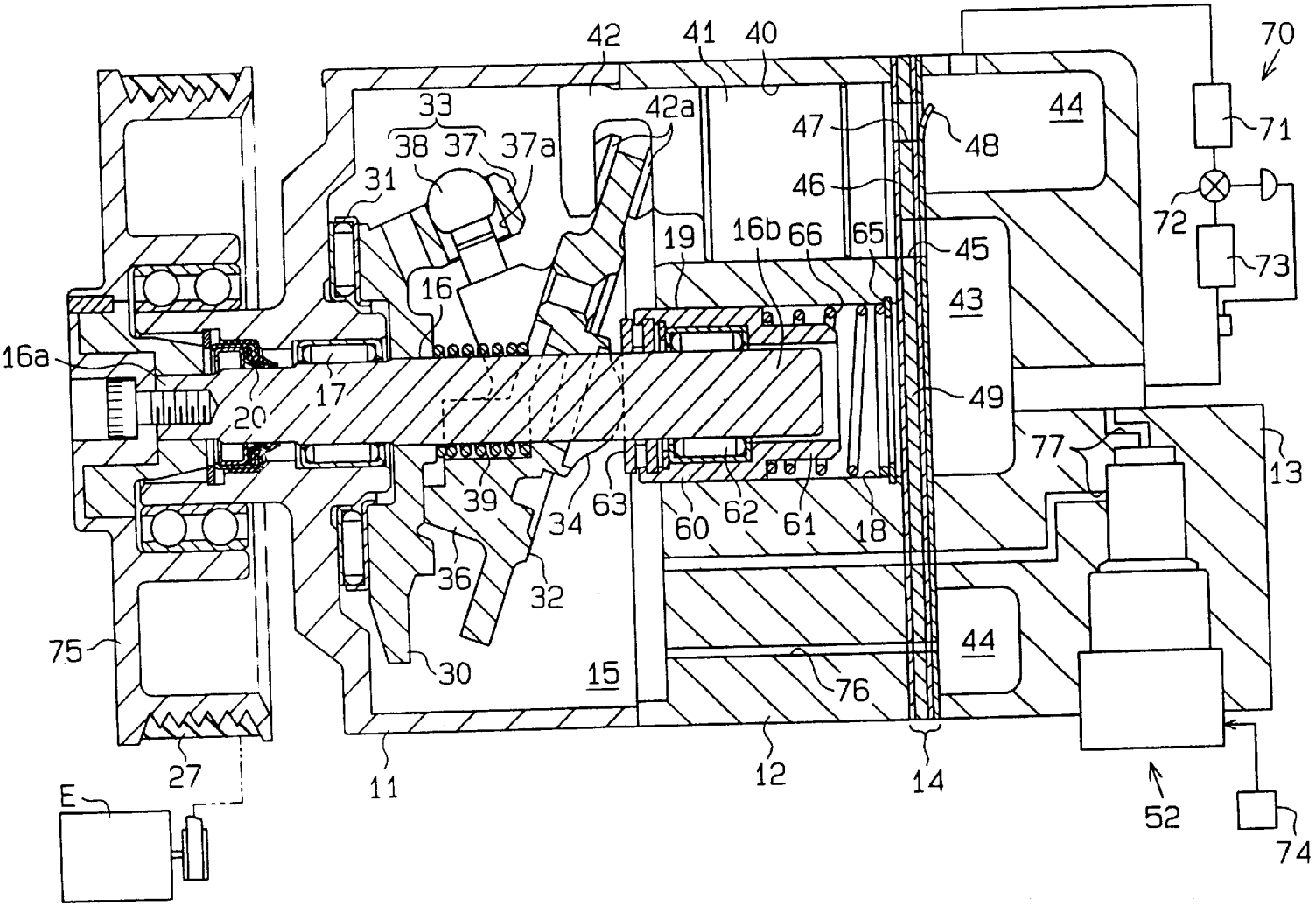
FIG. 4 is a cross-sectional view showing a variable displacement compressor according to a second embodiment.
Figure 5:
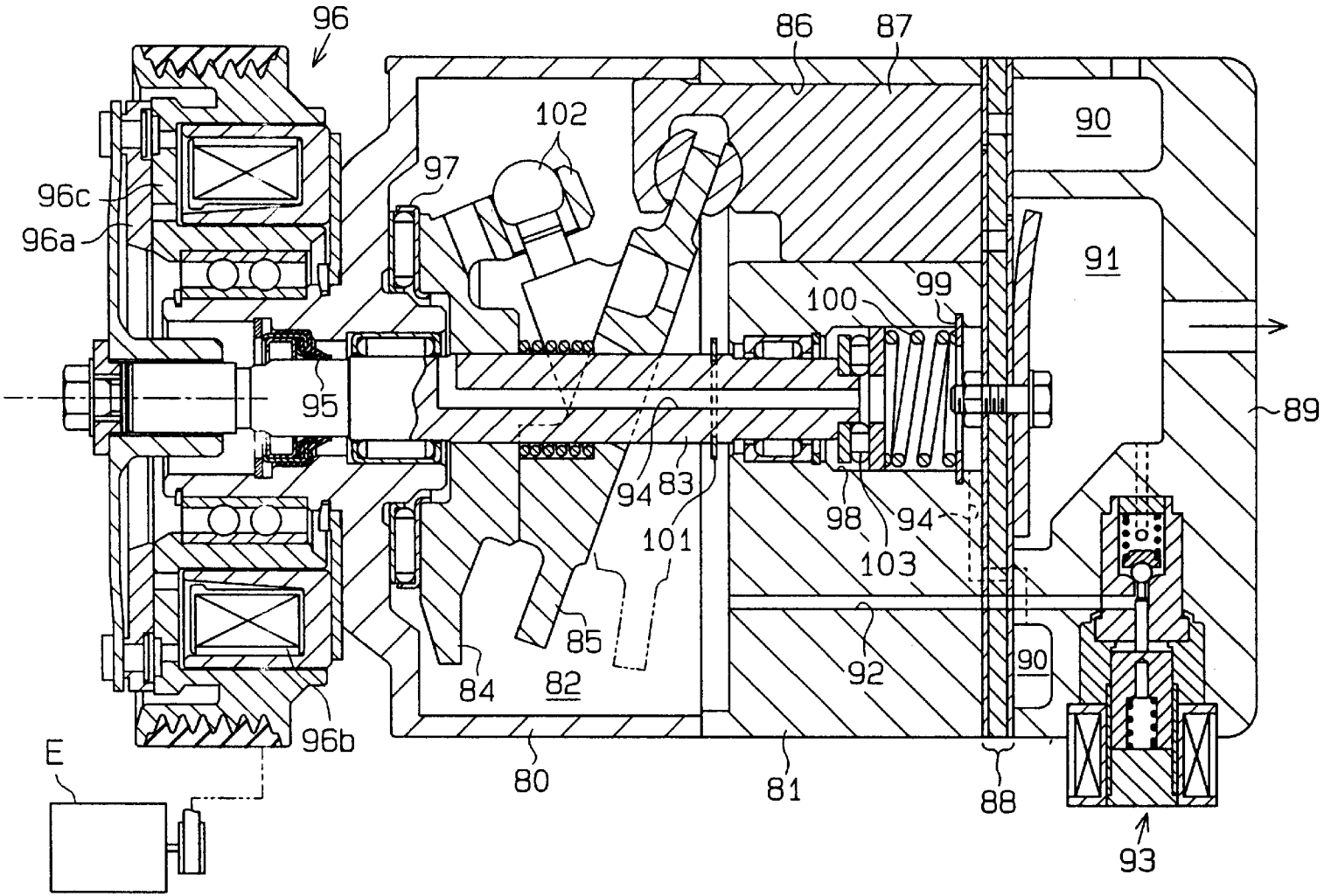
FIG. 5 is a cross-sectional view showing a prior art variable displacement compressor.

The present invention may be applied to a clutchless type compressor having no electromagnetic clutch 21 (shown in FIG. 1 or 3) and having a pulley 75 fixed to the drive shaft 16, as shown in FIG. 4.

In the compressor shown in FIG. 4, the control valve 52 is not located in the supply passage 76 connecting the discharge chamber 44 to the crank chamber 15. Instead, the electromagnetic control valve 52 is located in the bleed passage 77 connecting the crank chamber 15 to the suction chamber 43. In this case, the control valve 52 controls the flow rate of gas bled from the crank chamber 15 into the suction chamber 43. Further, both the supply passage and the bleed passage may be provided with control valves respectively.

The electromagnetic control valve 52 may have a pressure-sensing mechanism (bellows and the like) which moves the valve body 59 depending on the pressure in the suction chamber 43.

The electromagnetic control valve 52 may be of the type that is switched simply to the fully closed state and to the fully open state based on on/off of supply current.

The electromagnetic control valve may be located apart from the housing of the compressor.

What is claimed is:

1. A compressor, the displacement of which varies depending on the internal pressure of a crank chamber, the compressor comprising:

a housing including a cylinder block and a valve plate, which is connected to the cylinder block, wherein the cylinder block includes a cylinder bore and a central supporting hole;

a piston housed in the cylinder bore, wherein the piston compresses gas drawn into the cylinder bore through the valve plate and discharges compressed gas from the cylinder bore through the valve plate;

a drive shaft supported in the housing, the drive shaft having an end portion located in the supporting hole;

a drive plate connected to the piston for converting rotation of the drive shaft into reciprocating motion of the piston, wherein the drive plate is supported on the drive shaft and can incline with respect to the drive shaft between a maximum inclination position and a minimum inclination position depending on the internal pressure of the crank chamber, wherein the inclination of the drive plate determines the stroke of the piston and the displacement of the compressor;

a movable body housed in the supporting hole, wherein the movable body is hollow and permitted to move axially, and the end portion of the drive shaft is supported by the cylinder block through the movable body; and an urging member for urging the movable body toward the drive plate, wherein the movable body is moved axially as the drive plate is inclined, and when the drive plate is located at the minimum inclination angle position, the valve plate receives force from the drive plate through the movable body.

2. The compressor according to claim 1, wherein a thrust bearing is located between the drive plate and the movable body to permit rotation of the drive plate and the movable body relative to each other.

3. The compressor according to claim 1, wherein the movable body surrounds the end portion of the drive shaft, and a radial bearing is located between the movable body and the end portion of the drive shaft.

4. The compressor according to claim 1 wherein the urging member is a coil spring located in the supporting hole.

5. The compressor according to claim 1, wherein an external drive source is connected to the drive shaft, and a clutch mechanism, which selectively transmits power from an external drive source to the drive shaft, is located between the drive shaft and the external drive source, and the clutch mechanism includes a pair of clutch discs, which contact one another when the clutch is engaged and separate when the clutch is disengaged.

6. The compressor according to claim 1, wherein the movable body has first and second open ends, and the second end, which has an annular shape, contacts the valve plate when the drive plate is in the minimum inclination position.

7. The compressor according to claim 1 further comprising:

a discharge chamber defined in the housing;

a suction chamber defined in the housing;

a supply passage for supplying gas from the discharge chamber to the crank chamber;

a bleed passage for bleeding gas from the crank chamber to the suction chamber; and an electromagnetic control valve for adjusting the flow rate of gas flowing from the discharge chamber to the crank chamber through the supply passage.

8. The compressor according to claim 7, wherein the electromagnetic control valve fully opens the supply passage when no electric current is supplied to the electromagnetic control valve.

9. The compressor according to claim 7, wherein the bleed passage includes an axial passage defined in the drive shaft, wherein the axial passage connects the crank chamber and the supporting hole, and the bleed passage includes a port formed in the valve plate that connects the supporting hole and the suction chamber.

10. The compressor according to claim 9, wherein the movable body surrounds the end portion of the drive shaft, and when the drive plate is in the minimum inclination position, the movable body contacts the valve plate, and the axial passage communicates with the suction chamber through the port and the interior of the movable body.

11. A compressor, the displacement of which varies depending on the internal pressure of a crank chamber, the compressor comprising:

a housing including a cylinder block and a valve plate, which is connected to the cylinder block, wherein the cylinder block includes a cylinder bore and a central supporting hole;

a piston housed in the cylinder bore, wherein the piston compresses gas drawn into the cylinder bore through the valve plate and discharges compressed gas from the cylinder bore through the valve plate;

a drive shaft supported in the housing, the drive shaft having an end portion located in the supporting hole;

a drive plate connected to the piston for converting rotation of the drive shaft into reciprocating motion of the piston, wherein the drive plate is supported on the drive shaft and can incline with respect to the drive shaft between a maximum inclination position and a minimum inclination position, depending on the internal pressure of the crank chamber, wherein the inclination of the drive plate determines the stroke of the piston and the displacement of the compressor;

a movable body housed in the supporting hole, wherein the movable body is hollow and permitted to move axially, and the end portion of the drive shaft is supported by the cylinder block through the movable body; and an urging member for urging the movable body toward the drive plate, wherein the movable body is moved axially by the drive plate, and when the drive plate is located at the minimum inclination angle position, the movable body is pushed by the drive plate into contact with the valve plate.

12. The compressor according to claim 11, wherein a thrust bearing is located between the drive plate and the movable body to permit rotation of the drive plate and the movable body relative to each other.

13. The compressor according to claim 11, wherein the movable body surrounds the end portion of the drive shaft, and a radial bearing is located between the movable body and the end portion of the drive shaft.

14. The compressor according to claim 11 wherein the urging member is a coil spring located in the supporting hole.

15. The compressor according to claim 11, wherein an external drive source is connected to the drive shaft, and a clutch mechanism, which selectively transmits power from an external drive source to the drive shaft, is located between the drive shaft and the external drive source, and the clutch mechanism includes a pair of clutch discs, which contact one another when the clutch is engaged and separate when the clutch is disengaged.

16. The compressor according to claim 11, wherein the movable body has first and second open ends, and the second end, which has an annular shape, contacts the valve plate when the drive plate is in the minimum inclination position.

17. The compressor according to claim 11 further comprising:

a discharge chamber defined in the housing;

a suction chamber defined in the housing;

a supply passage for supplying gas from the discharge chamber to the crank chamber;

a bleed passage for bleeding gas from the crank chamber to the suction chamber; and an electromagnetic control valve for adjusting the flow rate of gas flowing from the discharge chamber to the crank chamber through the supply passage.

18. The compressor according to claim 17, wherein the electromagnetic control valve fully opens the supply passage when no electric current is supplied to the electromagnetic control valve.

19. The compressor according to claim 17, wherein the bleed passage includes an axial passage defined in the drive shaft, wherein the axial passage connects the crank chamber and the supporting hole, and the bleed passage includes a port formed in the valve plate that connects the supporting hole and the suction chamber.

20. The compressor according to claim 9, wherein the movable body surrounds the end portion of the drive shaft, and when the drive plate is in the minimum inclination position, the movable body contacts the valve plate, and the axial passage communicates with the suction chamber through the port and the interior of the movable body.

* * * * *